US011224270B2

(12) United States Patent
Tsui et al.

(10) Patent No.: US 11,224,270 B2
(45) Date of Patent: Jan. 18, 2022

(54) WATER AND DUST PROOF MULTI-FUNCTIONAL PACKAGE FOR RECEIVING TABLET ELECTRONIC DEVICE

(71) Applicants: Yun-Chang Tsui, Taipei (TW); Sampson Yang, Irvine, CA (US)

(72) Inventors: Yun-Chang Tsui, Taipei (TW); Sampson Yang, Irvine, CA (US)

(73) Assignee: The Joy Factory, Inc., Irvine, CA (US)

( * ) Notice: Subject to any disclaimer, the term of this patent is extended or adjusted under 35 U.S.C. 154(b) by 209 days.

(21) Appl. No.: 16/659,589

(22) Filed: Oct. 22, 2019

(65) Prior Publication Data

US 2021/0112939 A1 Apr. 22, 2021

(51) Int. Cl.
*A45C 11/00* (2006.01)

(52) U.S. Cl.
CPC ..... *A45C 11/00* (2013.01); *A45C 2011/002* (2013.01); *A45C 2011/003* (2013.01); *A45C 2200/10* (2013.01)

(58) Field of Classification Search
CPC ..... A45C 11/00; A45C 2011/002; A45C 2011/003; A45C 2200/10
USPC ..... 206/320
See application file for complete search history.

(56) References Cited

U.S. PATENT DOCUMENTS

| | | | | |
|---|---|---|---|---|
| 7,663,879 | B2 * | 2/2010 | Richardson | G06F 1/1613 361/679.56 |
| 2006/0021889 | A1 * | 2/2006 | Kim | A45C 11/00 206/320 |
| 2013/0220856 | A1 * | 8/2013 | Roach | A61N 1/3968 206/363 |
| 2013/0322013 | A1 * | 12/2013 | Steele | G06F 1/1656 361/679.55 |
| 2015/0000884 | A1 * | 1/2015 | Jiang | H05K 7/20418 165/185 |
| 2017/0099074 | A1 * | 4/2017 | Richardson | B65D 81/02 |
| 2018/0234127 | A1 * | 8/2018 | Lambert | A45C 11/00 |

* cited by examiner

*Primary Examiner* — Steven A. Reynolds

(57) ABSTRACT

A water and dust proof multi-functional package for receiving a tablet electronic device includes a seat; an upper cover; one side of the upper cover being pivotally connected to the seat and thus being turnable with respect to the seat; the upper cover having a transparent portion; the transparent portion being a transparent film which is adhered to the upper cover by waterproof glue; four buckles being positioned on lateral sides of the seat; each buckle containing a pivotal sheet and a buckling portion; the pivotal sheet being pivotally installed to the seat and being rotatable with respect to the seat. When the upper cover is closed, the outer side of the pivotal sheet is smooth to prevent dusts from adhering to the buckle. The buckle further comprises a waterproof adhering sheet for waterproof. Moreover, dusts are impossible to enter into the structure.

15 Claims, 6 Drawing Sheets

WATER AND DUST PROOF MULTI-FUNCTIONAL PACKAGE FOR RECEIVING TABLET ELECTRONIC DEVICE

FIELD OF INVENTION

The present invention relates to a package for receiving a tablet electronic device, and in particular to a water and dust proof multi-functional package for receiving a tablet electronic device.

BACKGROUND OF INVENTION

Tablet electronic devices are widely used in current trend, such as tablet computers, mobile phones, PDAs, notebook computers. All these devices have a flat form with a screen at one side. Many of these devices are developed with the function of portability so that they can be carried conveniently and easily. However, these kinds of electronic devices are designed just for electronic functions, while other functions, such as waterproof, dust proof, vibration proof, etc. are not considered in original designs. Therefore, to provide these functions, many multifunctional packages are developed for resolving these problems concurrent in the prior arts.

However, although the conventional multifunctional packages for tablet electronic devices are developed to resolve the prior art problems as described above, while they still have some disadvantages. For example, the waterproof function is not preferred so that if these devices are used for a long time, the buckling structure of the packages may become loose or be destroyed. As a result, the function of waterproof will be destroyed. Moreover, the buckling structure used in the packages does not provide a smooth outlook. They are uneven and thus some recesses or concave regions are formed at the outer sides of the packages so that some sands or dirt will adhere to the outer surfaces of these tablet electronic devices. Furthermore, it is general some keys are installed on the outer sides of the tablet electronic devices, while most of the multifunctional packages will shield these keys. This induces that these keys cannot be operated. Moreover, these packages do not provide preferred heat dissipation functions which cause that the heat generated from the electronic device placed within the package cannot be well dissipated. If the packages form some holes for heat dissipation, these holes will destroy the function of waterproof. Thus, it is not a preferred design.

Therefore, the inventor of the present invention desires to design a novel design, which can improve the defects as said above.

SUMMARY OF THE INVENTION

To improve above defects in the prior art, the present invention provides a water and dust proof multi-functional package for receiving a tablet electronic device, wherein the buckles with smooth outer surfaces are used to buckle the upper cover and the seat of the package of the present invention. The buckle buckles the upper cover by the inner side of the buckle. Therefore, the outer side of the buckle is very smooth so that dusts are impossible to enter into the buckle to prevent the tablet computer from dusts. In the present invention, the buckle has waterproof structure against any permeation of water and the sealing ring of the seat closes the inner frame inside of the upper cover. Moreover, the transparent portion is a transparent film adhered to the upper cover by waterproof glue. As a result, with above said structure, the package of the present invention forms a waterproof structure for protecting the tablet computer. The package of the present invention also has contact buttons to contact respective buttons of the tablet computer so that the user can use the buttons of the tablet computer as usual by using the contact buttons. Moreover, heat generated by the tablet computer will be transferred outwards by the heat dissipating metal of the seat. Therefore, the package of the present invention has a high heat dissipating performance. All above mentioned advantages of the present invention cannot be achieved by any prior art.

To achieve above object, the present invention provides a water and dust proof multi-functional package for receiving a tablet electronic device comprising: a seat having an approximately rectangular shape for supporting a tablet electronic device; an upper cover having an approximately rectangular shape; one side of the upper cover being pivotally connected to the seat and thus being turnable with respect to the seat; the upper cover having a transparent portion which is corresponding to a screen of the tablet electronic device so that a user can view the screen of the tablet electronic device; the transparent portion being a transparent film which is adhered to the upper cover by waterproof glue; four buckles being positioned on lateral sides of the seat; each buckle containing a pivotal sheet and a buckling portion; the pivotal sheet being pivotally installed to the seat and being rotatable with respect to the seat; the buckling portion being folded and extending upwards from the pivotal sheet; and an outer surface of the pivotal sheet being smooth; four combining portions formed at lateral sides of the upper cover and positions of the four combining portions being corresponding to those of the four buckles; and the four combining portions being protruded outwards for buckling with the buckling portions; wherein when the upper cover is closed on the seat, the buckles will buckle the buckling portions so that the upper cover and the seat are combined tightly and thus the tablet electronic device is enclosed therein; and since the buckling portion is at an inner side of the buckle so that the outer side of the pivotal sheet is smooth to prevent dusts from adhering to the buckle so as to present a beautiful outlook; wherein the buckle further comprises a waterproof adhering sheet so that when the buckles are buckled to the buckling portions, it form as a waterproof structure against any permeation of water; moreover, dusts are impossible to enter into the structure formed by the seat, the buckle and the upper cover.

DETAILED DESCRIPTION OF THE INVENTION

Figure 1:
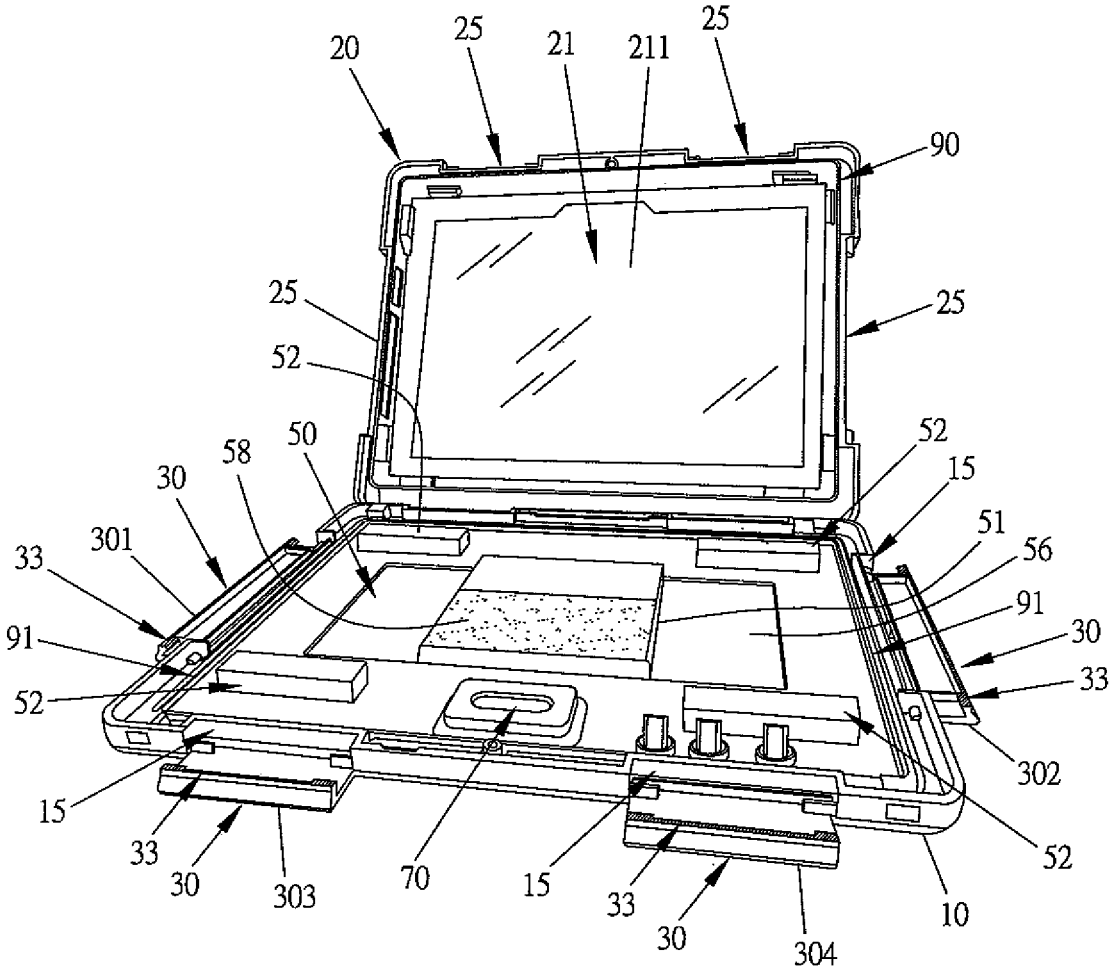
FIG. 1 is an assembly schematic view of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

In the present invention, a tablet computer 1 is used for description of the present invention, however the present invention is suitable for various kinds of tablet (or flat form) electronic devices, such as tablet computers, mobile phones, PDA (personal digital assistant), notebook computers, etc. Preferably, these tablet electronic device has a flat back side.

With reference to FIGS. 1 to 10, the structure of the present invention is illustrated. The present invention contains the following elements.

A seat 10 is approximately rectangular for supporting the tablet computer 1.

An upper cover 20 is approximately rectangular. One side of the upper cover 20 is pivotally connected to the seat 10 and thus is turnable with respect to the seat 10. As illustrated is FIGS. 1 and 3, the upper cover 20 has a transparent portion 21 which is corresponding to a screen 2 of the tablet computer 1 so that a user can view the screen 2 of the tablet computer 1. The transparent portion 21 is a transparent film 211 which is adhered to the upper cover 20 by waterproof glue.

Figure 2:
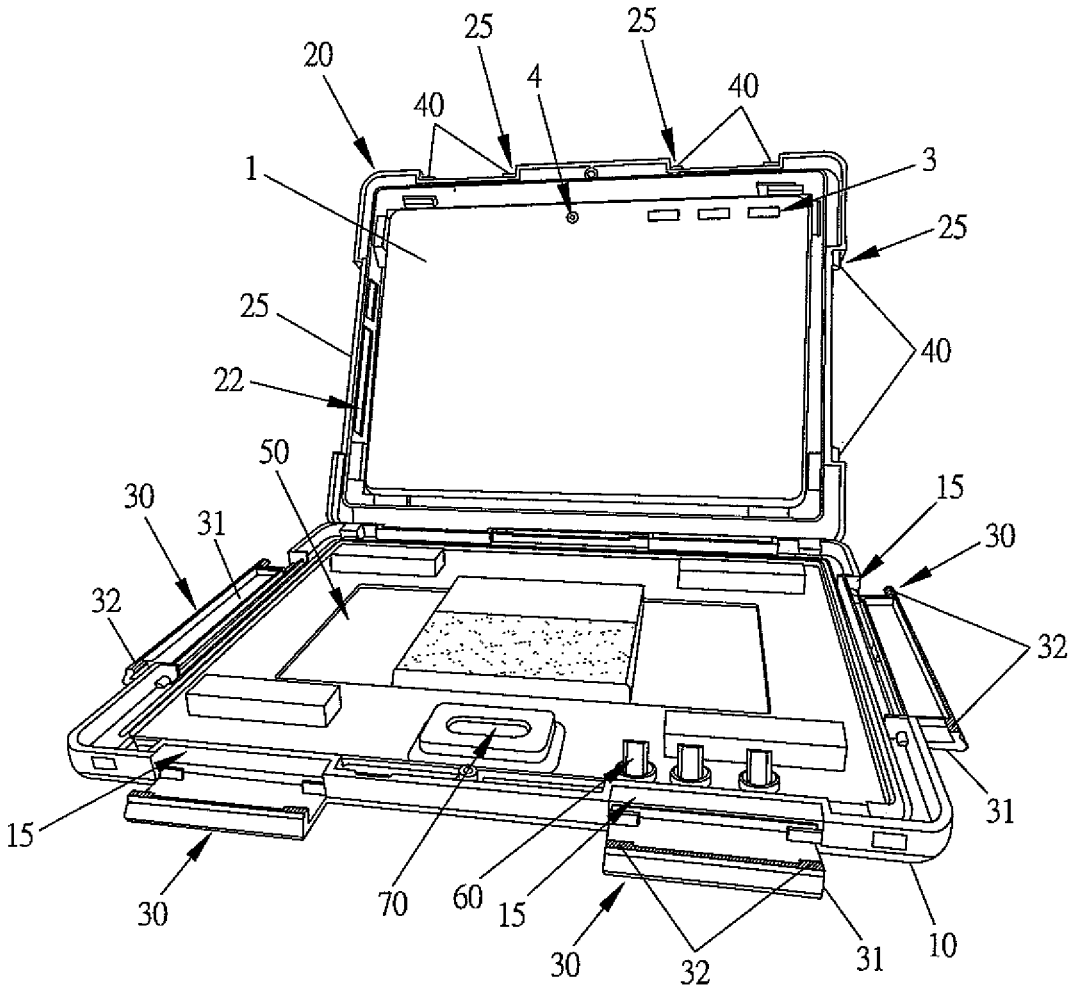
FIG. 2 is a schematic view showing that the tablet computer is placed within the upper cover.
Figure 3:
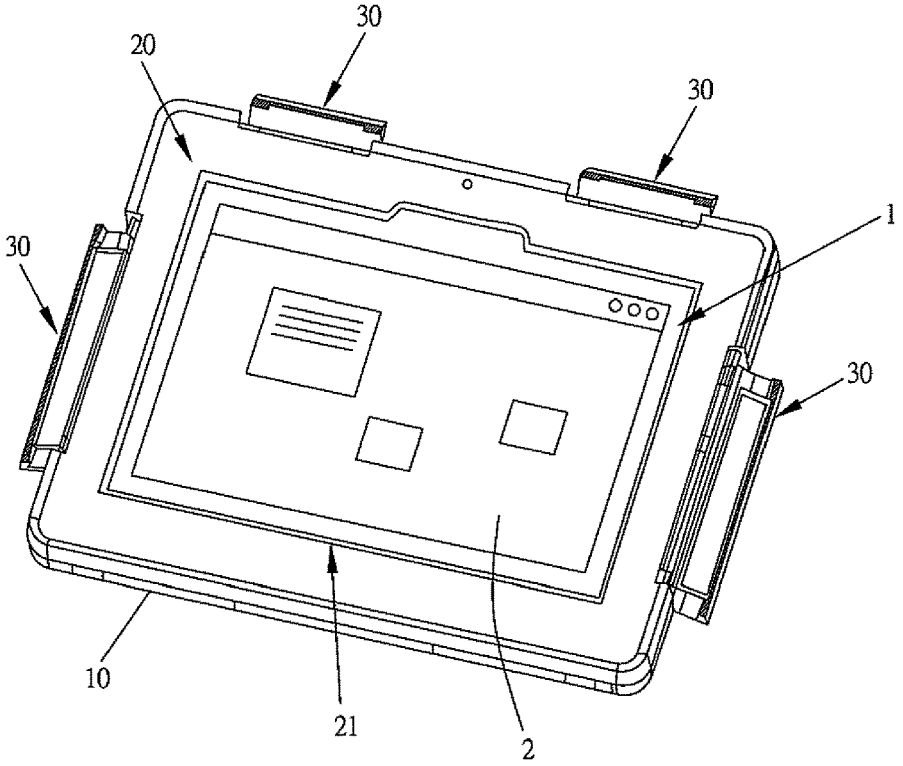
FIG. 3 is a schematic view showing that the upper cover and the seat are in a closing state.

Four buckles 30 are positioned on lateral sides of the seat 10, as illustrated in FIG. 2. Each buckle 30 contains a pivotal sheet 31 and a buckling portion 32. The pivotal sheet 31 is pivotally installed to the seat 10 and is rotatable with respect to the seat 10. The buckling portion 32 is folded and extends upwards from the pivotal sheet 31. An outer surface of the pivotal sheet 31 is smooth. The four buckles 30 contains a left buckle 301 at a left side of the seat 10; a right buckle 302 at a right side of the seat 10, and two front buckle 303, 304 at a front side of the seat 10.

Four combining portions 40 are formed at lateral sides of the upper cover 20 and positions of the four combining portions 40 are corresponding to those of the four buckles 30. The four combining portions 40 are protruded outwards for buckling with the buckling portions 32.

Figure 4:
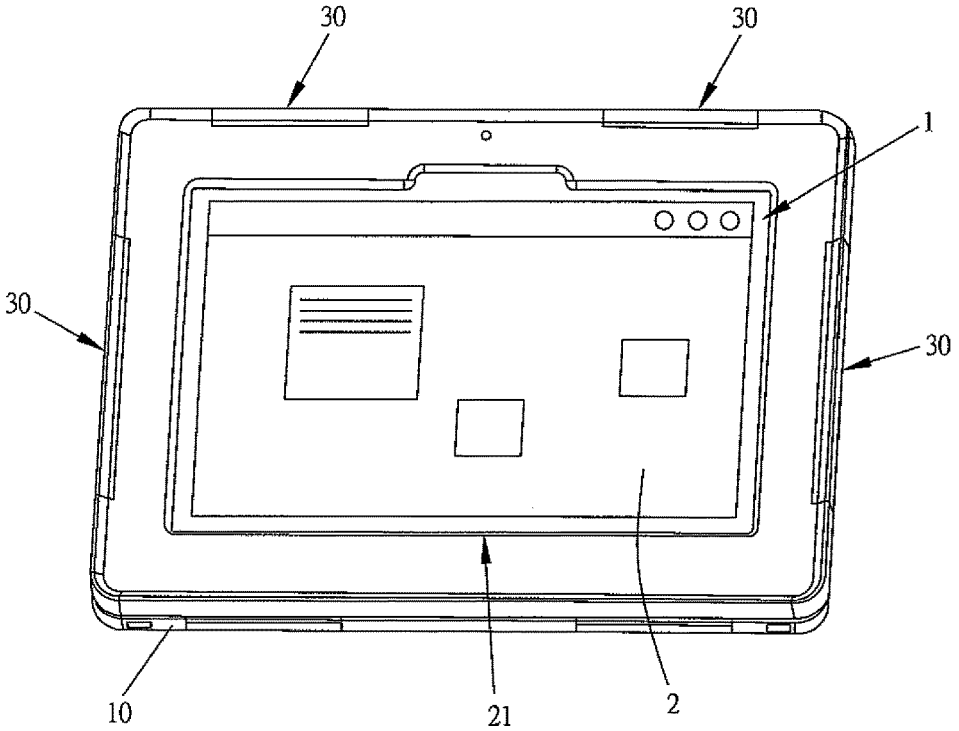
FIG. 4 is a schematic view showing the assembly of the upper cover, the seat and the buckles.

As illustrated in FIG. 4, when the upper cover 20 is closed on the seat 10, the buckles 30 will buckle the buckling portions 32 so that the upper cover 20 and the seat 10 are combined tightly and thus the tablet computer 1 is enclosed therein. Since the buckling portion 32 is at an inner side of the buckle 30 so that the outer side of the pivotal sheet 31 is smooth to prevent dusts from adhering to the buckle 30 and present a beautiful outlook.

The buckle 30 further comprises a waterproof adhering sheet 33 so that when the buckles 30 are buckled to the buckling portions 32, it form as a waterproof structure against any permeation of water. Moreover, dusts are impossible to enter into the structure formed by the seat 10, the buckle 30 and the upper cover 20.

An inner frame 90 is located in an inner side the upper cover 20.

A sealing ring 91 is located around an inner side of the seat 10. In assembly state, the inner frame 90 surrounds an outer side of the tablet computer 1 and the inner frame 90 closes the sealing ring 91 to form a closing space between the seat 10, the upper cover 20 and the inner frame 90. The closing space is used to place the tablet computer 1 and is capable of preventing water permeation. The sealing ring 91 is made of waterproof material, such as rubbers.

By using above said transparent portion 21 with waterproof glue, the waterproof adhering sheet 33 of the buckle 30 and the sealing ring 91, when the upper cover 20 is buckled with the seat 10, the package of the present invention will form a high waterproof closing structure for preventing water permeation so as to protect the tablet computer 1.

Preferably, the lateral sides of the seat 10 are formed with four lower grooves 15. Each buckle 30 is located in a respective one of the lower grooves 15. The lateral sides of the upper cover 20 are formed with four upper grooves 25. Each combining portions 40 is located in the respective upper groove 25. Rotating the buckle 30 to buckle the combining portions 40 will cause the buckle 30 to embed into a space between the respective upper groove 25 of the upper cover 20 and the respective lower groove 15 in the seat 10. As a result, an outer side of the buckle 30 is flushed with the lateral sides of the upper cover 20 and the seat 10. Therefore, the upper cover 20, the seat 10 and the buckle 30 form an integral structure.

A heat dissipating structure 50 is included. An inner side of the heat dissipating structure 50 is located in the inner side of the seat 10. The heat dissipating structure 50 contains a heat dissipating metal 56. A center of the heat dissipating metal 56 has a platform 51 protruded upwards. An outer side of the heat dissipating structure 50 is exposed to a bottom of the seat 10. The heat dissipating structure 50 serves to support a bottom of the tablet computer 1 so that heat generated by the tablet computer 1 transfers to an outside of the seat 10. Preferably, an upper side of the platform 51 has a heat sink 58 which is used to contact the tablet computer 1 so that heat effectively transfers to the heat dissipating metal 56 and then transfers to an outside of the tablet computer 1 for the purpose of heat dissipation.

Figure 9:
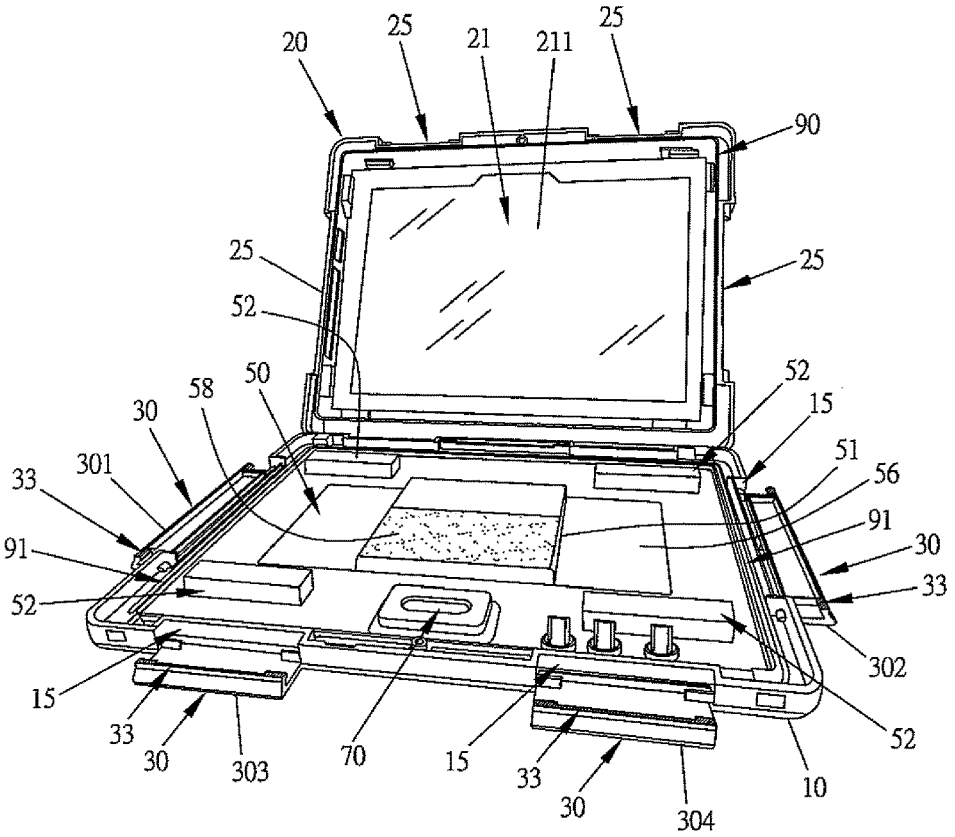
FIG. 9 is another assembly schematic view of the present invention.
Figure 10:
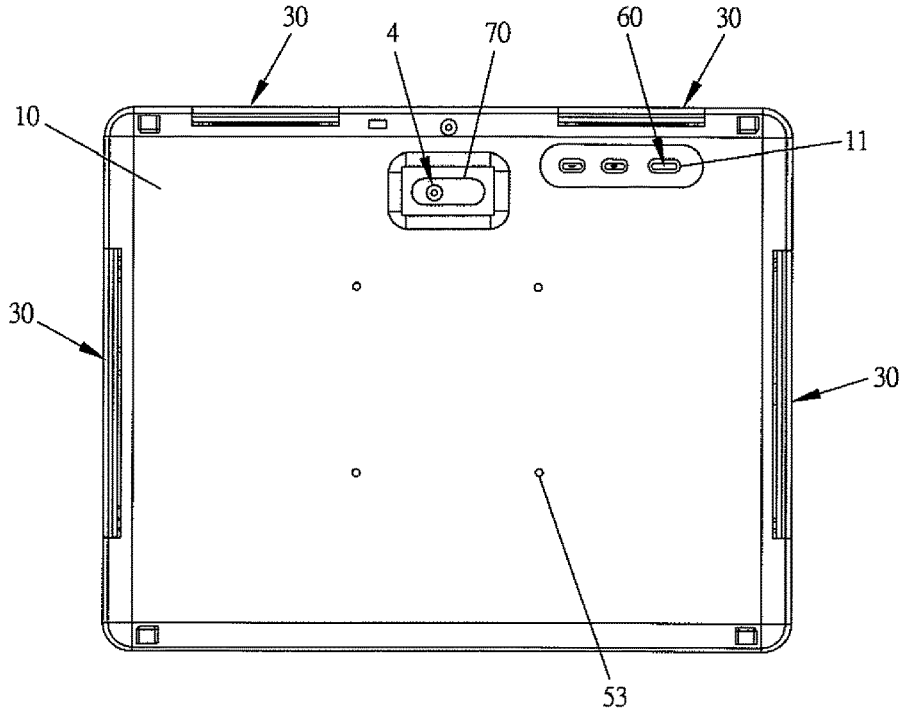
FIG. 10 is a schematic view showing the backside of the seat of FIG. 9.

As shown in FIGS. 9 and 10, the heat dissipating structure 50 is completely located at the inner side of the seat 10 and the heat dissipating structure 50 contacts the seat 10. The heat dissipating structure 50 serves to support the bottom of the tablet computer 1 so that heat generated by the tablet computer 1 transfers to the whole seat 10.

At least one shockproof pad 52 is located in the seat 10. The shockproof pad 52 serves for supporting the tablet computer 1. As shown in FIG. 2, there are four shockproof pads 52 positioned around the heat dissipating structure 50.

Figure 5:
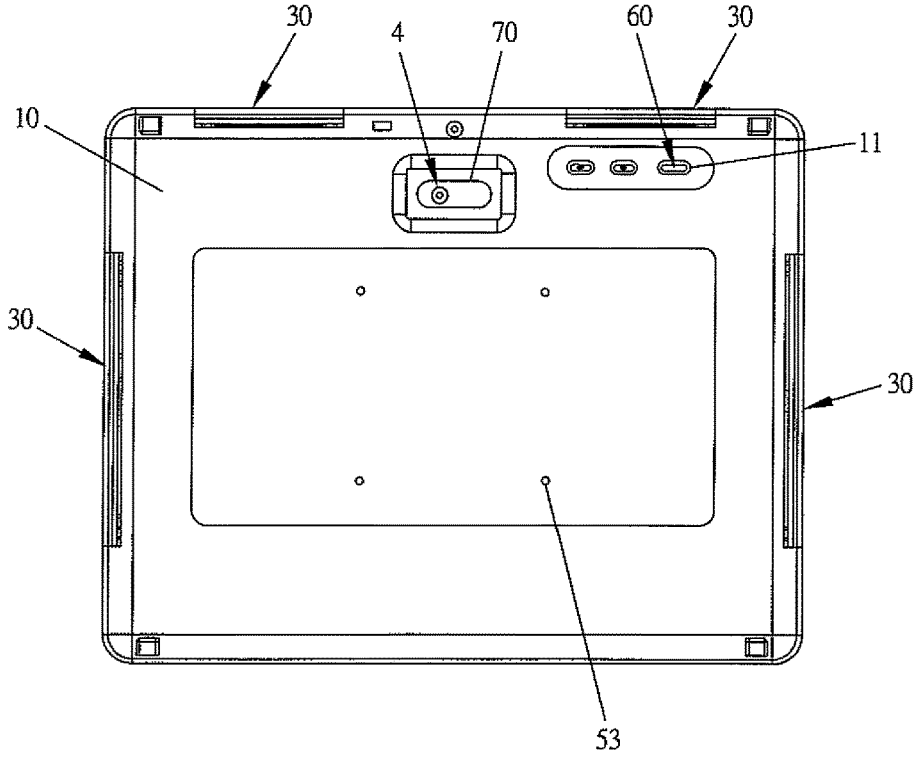
FIG. 5 is a schematic view showing a backside of the seat.

At least one contact button 60 is located in the seat 10. A position of the contact button 60 is corresponding to that of a button 3 of the tablet computer 1. An outer end of the contact button 60 passes through a respective through hole 11 (as shown in FIG. 5) of the seat 10 and exposes out of the bottom of the seat 10. An inner end of the contact button 60 is used to contact the button 3 of the tablet computer 1 so that a user can operate the button 3 of the tablet computer 1 by pressing the respective contact button 60.

At least one camera hole 70 is formed in the bottom of the seat 10. A position of the camera hole 70 is corresponding to that of a camera of the tablet computer 1 so that the camera of the tablet computer 1 is capable of shooting photos through the camera hole 70.

Figure 8:
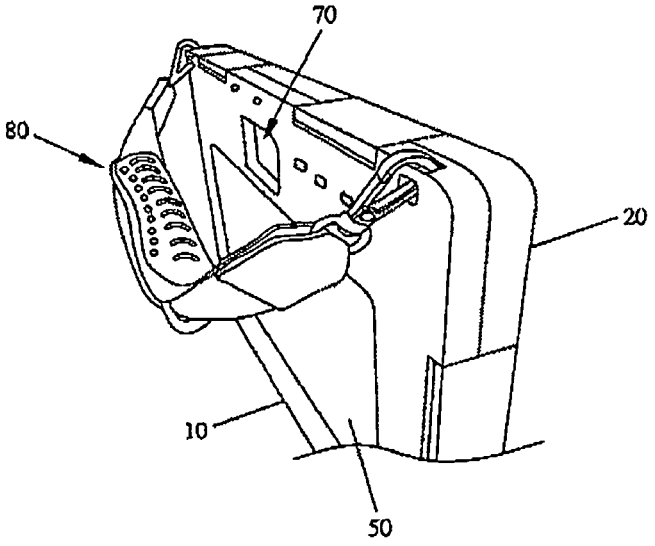
FIG. 8 is a schematic view showing the strap of the present invention.

A strap 80 is included. Two ends of the strap 80 are connected to the upper cover 20 or the seat 10 so that the user can hold or carry the tablet computer 1 by using the strap 80. As shown in FIG. 8, the two ends of the strap 80 are connected to two sides of the seat 10 by detachable way.

Figure 7:
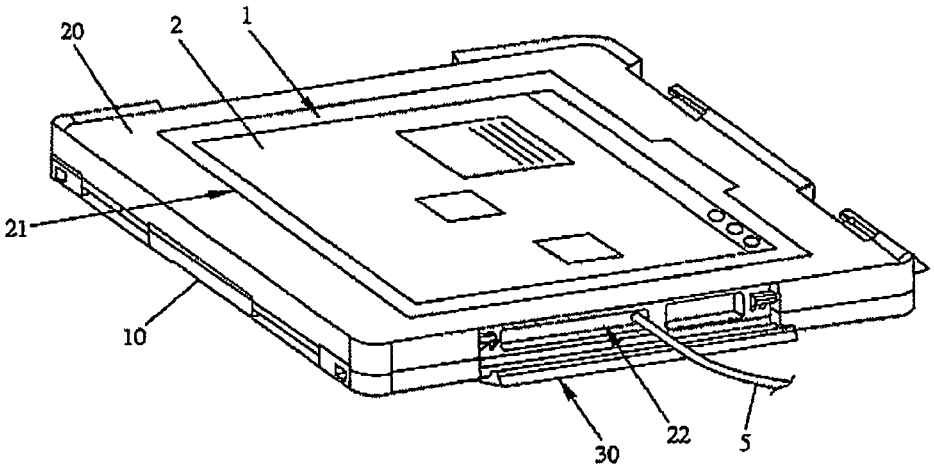
FIG. 7 is a schematic view showing the connecting holes of the upper cover.

As shown in FIGS. 2 and 7, the lateral sides of the upper cover 20 have at least one connecting hole 22 and a position of the connecting hole 22 is formed with respect to a connecting port (not shown) of the tablet computer 1. Therefore, an external connecting wire 5 is capable of passing into the upper cover 20 to connect a respective connecting port of the tablet computer 1 by the connecting hole 22 so as to perform required operations.

When using, the tablet computer 1 is placed within the upper cover 20 and the upper cover 20 is closed on the seat 10. Then each buckle 30 of the seat 10 is rotated to buckle the respective buckling portions 32 of the upper cover 20.

Figure 6:
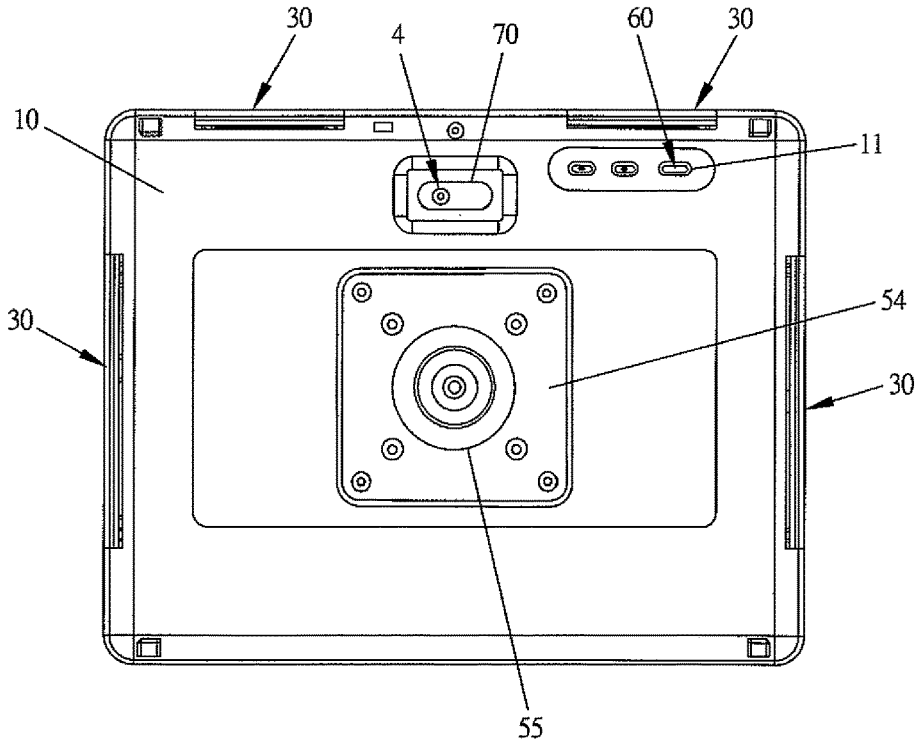
FIG. 6 is a schematic view showing the connection of the connecting object and the backside of the seat.

As shown in FIG. 5, the outer side of the heat dissipating structure 50 has a plurality of locking holes 53. The locking hole 53 serves for being connected to a connecting object 54 (as shown in FIG. 6). The connecting object 54 has a rotatable disk 55 for being connected to an external supporting object (not shown) so as to cause the package of the present invention to stand. By rotating of the rotatable disk 55, the package of the present invention stands by a predetermined angle. As shown in FIG. 10, when the heat dissipating structure 50 is completely located in the inner side of the seat 10, the plurality of locking holes 53 is located in the seat 10.

Advantages of the present invention are that in the present invention, the buckles with smooth outer surfaces are used to buckle the upper cover and the seat of the package of the present invention. The buckle buckles the upper cover by the inner side of the buckle. Therefore, the outer side of the buckle is very smooth so that dusts are impossible to enter into the buckle to prevent the tablet computer from dusts. In the present invention, the buckle has waterproof structure against any permeation of water and the sealing ring of the seat closes the inner frame inside of the upper cover. Moreover, the transparent portion is a transparent film adhered to the upper cover by waterproof glue. As a result, with above said structure, the package of the present invention forms a waterproof structure for protecting the tablet computer. The package of the present invention also has contact buttons to contact respective buttons of the tablet computer so that the user can use the buttons of the tablet computer as usual by using the contact buttons. Moreover, heat generated by the tablet computer will be transferred outwards by the heat dissipating metal of the seat. Therefore, the package of the present invention has a high heat dissipating performance. All above mentioned advantages of the present invention cannot be achieved by any prior art.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A water and dust proof multi-functional package for receiving a tablet electronic device comprising:

a seat having an approximately rectangular shape for supporting a tablet electronic device;

an upper cover having an approximately rectangular shape; one side of the upper cover being pivotally connected to the seat and thus being turnable with respect to the seat; the upper cover having a transparent portion which is corresponding to a screen of the tablet electronic device so that a user can view the screen of the tablet electronic device; the transparent portion being a transparent film which is adhered to the upper cover by waterproof glue;

four buckles; at least one of the buckles being positioned on each of lateral sides of the seat; each buckle containing a pivotal sheet and a buckling portion; the pivotal sheet being pivotally installed to the seat and being rotatable with respect to the seat; the buckling portion being angled, and extending upwards from the pivotal sheet; and an outer surface of the pivotal sheet being smooth;

four combining portions; at least one of the combining portions being positioned on each of lateral sides of the upper cover and positions of the four combining portions being corresponding to those of the four buckles; and the four combining portions being protruded outwards for buckling with the buckling portions;

wherein when the upper cover is closed on the seat, the buckles will buckle the combining portions so that the upper cover and the seat are combined tightly and thus the tablet electronic device is enclosed therein; wherein the buckling portion is at an inner side of the buckle and the outer side of the pivotal sheet is smooth to prevent dusts from adhering to the buckle so as to present a beautiful outlook;

wherein the buckle further comprises a waterproof adhering sheet so that when the buckles are buckled to the combining portions, it forms a waterproof structure against any permeation of water; moreover, dusts are prevented from entering into the structure formed by the seat, the buckle and the upper cover;

a heat dissipating structure; an inner side of the heat dissipating structure being located in the inner side of the seat; the heat dissipating structure containing a heat dissipating metal; a center of the heat dissipating metal having a platform protruded upwards; an outer side of the heat dissipating structure being exposed to a bottom of the seat; and the heat dissipating structure serving to support a bottom of the tablet electronic device so that heat generated by the tablet electronic device transfers to an outside of the seat; and wherein the outer side of the heat dissipating structure has a plurality of locking holes; the locking hole serves for being connected to a connecting object; the connecting object has a rotatable disk for being connected to an external supporting object has to cause the package to stand; and by rotating of the rotatable disk, the package stands by a predetermined angle.

2. The water and dust proof multi-functional package for receiving a tablet electronic device as claimed in claim 1, further comprising:

an inner frame being located in an inner side the upper cover;

a sealing ring being located around an inner side of the seat; in an assembled state, the inner frame surrounds an outer side of the tablet electronic device and the inner frame encloses the sealing ring to form a closing space between the seat, the upper cover and the inner frame; and the closing space being used to place the tablet electronic device and being capable of preventing water permeation; the sealing ring being made of waterproof material.

3. The water and dust proof multi-functional package for receiving a tablet electronic device as claimed in claim 1, wherein an upper side of the platform has a heat sink which is used to contact the tablet electronic device so that heat effectively transfers to the heat dissipating metal for the purpose of heat dissipation.

4. The water and dust proof multi-functional package for receiving a tablet electronic device as claimed in claim 1, wherein the four buckles contains a left buckle at a left side of the seat; a right buckle at a right side of the seat, and two front buckles at a front side of the seat.

5. The water and dust proof multi-functional package for receiving a tablet electronic device as claimed in claim 1, wherein the lateral sides of the seat are formed with four lower grooves; each buckle is located in a respective one of the lower grooves; the lateral sides of the upper cover are formed with four upper grooves; each combining portion is located in the respective upper groove; rotating the buckle to buckle the combining portions will cause the buckle to embed into a space between the respective upper groove of the upper cover and the respective lower groove in the seat; as a result, an outer side of the buckle is flushed with the lateral sides of the upper cover and the seat; therefore, the upper cover, the seat and the buckle form an integral structure.

6. The water and dust proof multi-functional package for receiving a tablet electronic device as claimed in claim 1, further comprising:

at least one shockproof pad being located in the seat; and the shockproof pad serving for supporting the tablet electronic device.

7. The water and dust proof multi-functional package for receiving a tablet electronic device as claimed in claim 6, wherein there are four shockproof pads.

8. The water and dust proof multi-functional package for receiving a tablet electronic device as claimed in claim 1, further comprising:

at least one contact button being located in the seat; a position of the contact button being corresponding to that of a button of the tablet electronic device; an outer end of the contact button passing through a respective through hole of the seat and exposing out of the bottom of the seat; and an inner end of the contact button being used to contact the button of the tablet electronic device so that the user can operate the button of the tablet electronic device by pressing the respective contact button.

9. The water and dust proof multi-functional package for receiving a tablet electronic device as claimed in claim 1, further comprising:

at least one camera hole formed in the bottom of the seat; a position of the camera hole being corresponding to that of a camera of the tablet electronic device so that the camera of the tablet electronic device is capable of shooting photos through the camera hole.

10. The water and dust proof multi-functional package for receiving a tablet electronic device as claimed in claim 1, further comprising:

a strap; two ends of the strap being connected to the upper cover or the seat by detachable way so that a user can hold or carry the tablet electronic device by using the strap.

11. The water and dust proof multi-functional package for receiving a tablet electronic device as claimed in claim 1, wherein the lateral sides of the upper cover have at least one connecting hole and a position of the connecting hole is formed with respect to a connecting port of the tablet electronic device; therefore, an external connecting wire is capable of passing into the upper cover to connect a respective connecting port of the tablet electronic device by the connecting hole.

12. The water and dust proof multi-functional package for receiving a tablet electronic device as claimed in claim 1, wherein the tablet electronic device is selected from tablet computers, mobile phones, PDA (personal digital assistant), and notebook computers.

13. A water and dust proof multi-functional package for receiving a tablet electronic device comprising:

a seat having an approximately rectangular shape for supporting a tablet electronic device;

an upper cover having an approximately rectangular shape; one side of the upper cover being pivotally connected to the seat and thus being turnable with respect to the seat; the upper cover having a transparent portion which is corresponding to a screen of the tablet electronic device so that a user can view the screen of the tablet electronic device; the transparent portion being a transparent film which is adhered to the upper cover by waterproof glue;

four buckles; at least one of the buckles being positioned on each of lateral sides of the seat; each buckle containing a pivotal sheet and a buckling portion; the pivotal sheet being pivotally installed to the seat and being rotatable with respect to the seat; the buckling portion being angled and extending upwards from the pivotal sheet; and an outer surface of the pivotal sheet being smooth;

four combining portions; at least one of the combining positions being positioned on each of lateral sides of the upper cover and positions of the four combining portions being corresponding to those of the four buckles; and the four combining portions being protruded outwards for buckling with the buckling portions;

wherein when the upper cover is closed on the seat, the buckles will buckle the combining portions so that the upper cover and the seat are combined tightly and thus the tablet electronic device is enclosed therein; wherein the buckling portion is at an inner side of the buckle and the outer side of the pivotal sheet is smooth to prevent dusts from adhering to the buckle so as to present a beautiful outlook;

wherein the buckle further comprises a waterproof adhering sheet so that when the buckles are buckled to the combining portions, it forms a waterproof structure against any permeation of water; moreover, dusts are prevented from entering into the structure formed by the seat, the buckle and the upper cover;

a heat dissipating structure; the hear dissipating structure being completely located at the inner side of the seat and the heat dissipating structure contacting the seat; and the heat dissipating structure serving to support the bottom of the tablet electronic device so that heat generated by the tablet electronic device transfers to the seat; and wherein the seat forms plurality of locking holes; wherein the plurality of locking holes are connected to a connecting object; the connecting object has a rotatable disk for being connected to an external supporting object as to cause the package to stand; and by rotating of the rotatable disk, the package stands by a predetermined.

14. The water and dust proof multi-functional package for receiving a tablet electronic device as claimed in claim 13, further comprising:

an inner frame being located in an inner side the upper cover;

a sealing ring being located around an inner side of the seat; in an assembled state, the inner frame surrounds an outer side of the tablet electronic device and the inner frame encloses the sealing ring to form a closing space between the seat, the upper cover and the inner frame; and the closing space being used to place the tablet electronic device and being capable of preventing water permeation; the sealing ring being made of waterproof material.

15. The water and dust proof multi-functional package for receiving a tablet electronic device as claimed in claim 13, wherein the lateral sides of the seat are formed with four lower grooves; each buckle is located in a respective one of the lower grooves; the lateral sides of the upper cover are formed with four upper grooves; each combining portion is located in the respective upper groove; rotating the buckle to buckle the combining portions will cause the buckle to embed into a space between the respective upper groove of the upper cover and the respective lower groove in the seat; as a result, an outer side of the buckle is flushed with the lateral sides of the upper cover and the seat; therefore, the upper cover, the seat and the buckle form an integral structure.

* * * * *